US010553161B2

(12) United States Patent
Yuan et al.

(10) Patent No.: US 10,553,161 B2
(45) Date of Patent: Feb. 4, 2020

(54) GATE DRIVING UNIT, GATE DRIVING CIRCUIT, DISPLAY DRIVING CIRCUIT AND DISPLAY DEVICE

(71) Applicants: BOE Technology Group Co., Ltd., Beijing (CN); Hefei Xinsheng Optoelectronics Technology Co., Ltd., Hefei (CN)

(72) Inventors: Zhidong Yuan, Beijing (CN); Yongqian Li, Beijing (CN); Min He, Beijing (CN); Can Yuan, Beijing (CN); Pan Xu, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 31 days.

(21) Appl. No.: 15/833,080

(22) Filed: Dec. 6, 2017

(65) Prior Publication Data

US 2018/0330667 A1 Nov. 15, 2018

(30) Foreign Application Priority Data

May 12, 2017 (CN) ..... 2017 1 0336104

(51) Int. Cl.
*G09G 3/3258* (2016.01)
*G09G 3/3266* (2016.01)
*G09G 3/3233* (2016.01)

(52) U.S. Cl.
CPC ..... *G09G 3/3258* (2013.01)

(58) Field of Classification Search
None
See application file for complete search history.

(56) References Cited

U.S. PATENT DOCUMENTS

2017/0294165 A1* 10/2017 Park ..... G11C 19/28

* cited by examiner

*Primary Examiner* — Ifedayo B Iluyomade
(74) *Attorney, Agent, or Firm* — Banner & Witcoff, Ltd.

(57) ABSTRACT

A gate driving unit, a gate driving circuit, a display driving circuit and a display device. The gate driving unit comprises: an input circuit; a first control circuit, configured to provide a first power voltage signal to a first control node in a case that a pull-up node is at an active voltage level; a second control circuit, configured to provide a third clock signal of a third clock terminal to a second control node in a case that the pull-up node is at the active voltage level, and pull down the second control node to a second power voltage signal of a second power voltage terminal in a case that the pull-up node is at a non-active voltage level; and an output circuit, configured to output the first power voltage signal of a first power voltage terminal to the output terminal.

20 Claims, 12 Drawing Sheets

GATE DRIVING UNIT, GATE DRIVING CIRCUIT, DISPLAY DRIVING CIRCUIT AND DISPLAY DEVICE

This application claims priority to and the benefit of Chinese Patent Application No. 201710336104.3 filed on May 12, 2017, which application is incorporated herein in its entirety.

TECHNICAL FIELD

Embodiments of the present disclosure relate to a gate driving unit, a gate driving circuit, a display driving circuit and a display device.

BACKGROUND

Currently, there are various backplane technologies in a display industry, such as a-Si, LTPS, Oxide and so on, where: the a-Si is easily manufactured, but its mobility is low and its stability is not ideal; the LTPS has good stability, but a cost of the LTPS is high, uniformity of the LTPS is poor, and the LTPS is not suitable for manufacture of a panel with a large size. IGZO (indium zinc gallium oxide) is widely used in an OLED product with a large size due to its high mobility, good uniformity and low cost.

Luminescence uniformity of AMOLED is affected by a threshold voltage Vth, and in pixel design, a circuit for compensating the Vth may be added.

Pulses need to be added for internal compensation of a Scan signal, so as to extend a time of resetting and obtaining the value of Vth.

A traditional method adopts a peripheral IC design, which is not beneficial for a narrow frame and low cost.

Compensation periods of different panels are different, and so the number of pulses in the Scan signal is not fixed.

SUMMARY

An embodiment of the present disclosure provides a gate driving unit, comprising: an input circuit, configured to transmit an output signal of a previous-level gate driving unit to a pull-up node in a case that one of an output terminal of the previous-level gate driving unit and an output terminal of a next-level gate driving unit is at an active voltage level, and a first clock terminal is the an active voltage level; a first control circuit, configured to provide a first power voltage signal to a first control node in a case that the pull-up node is at the active voltage level; a second control circuit, configured to provide a third clock signal of a third clock terminal to a second control node in a case that the pull-up node is at the active voltage level, and pull down the second control node to a second power voltage signal of a second power voltage terminal in a case that the pull-up node is at a non-active voltage level; and an output circuit, configured to output the first power voltage signal of a first power voltage terminal to the output terminal in a case that the first control node is at the active voltage level and the second control node is at the non-active voltage level.

An embodiment of the present disclosure further provides a gate driving circuit, comprising N gate driving units connected in cascade. The N gate driving units comprise a first gate driving unit to an Nth gate driving unit, each gate driving unit is the gate driving unit mentioned above, and N is an integer greater than or equal to 2.

An embodiment of the present disclosure further provides a display driving circuit, comprising: a gate driving circuit and a pixel driving circuit. The gate driving circuit comprises the gate driving circuit mentioned above.

An embodiment of the present disclosure further provides a display device, comprising the display driving circuit mentioned above.

Embodiments of the present disclosure use a circuit structure with two control circuits to control an output circuit, so that noise can be stably and continuously suppressed. In addition, an embodiment of the present disclosure can also implement a function of a programmable multi-pulse gate driving unit, and furthermore the gate driving unit of an embodiment of the present disclosure can be self-adaptive to a number of initial pulses, that is, a working range is not limited by the number of the pulses.

BRIEF DESCRIPTION OF THE DRAWINGS

Example embodiments of the present disclosure will be described in detail in conjunction with the accompanying drawings, and the above and other objects, features and advantages of the present disclosure will become more apparent. In the drawings, same reference numerals denote same structural units, and.

DETAILED DESCRIPTION

Figure 1:
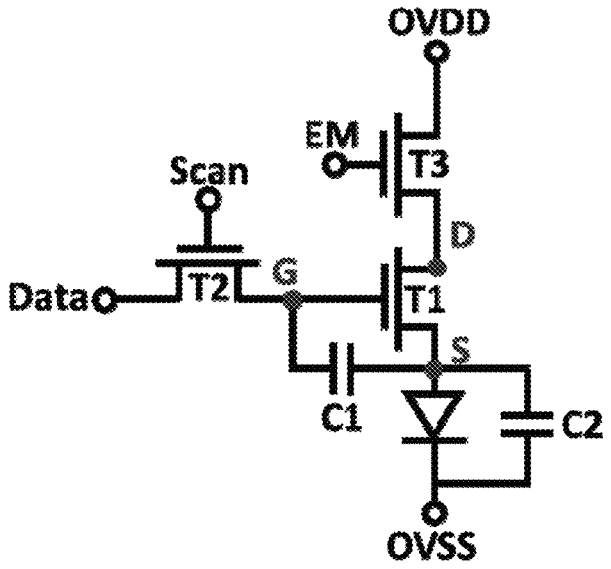
FIG. 1 shows a 3T2C internal compensation circuit.

The present disclosure will be fully described below with reference to the accompanying drawings illustrated in embodiments of the present disclosure. However, the present disclosure can be implemented in many different forms and should not be limited to the embodiments described herein. In contrast, these embodiments are provided to describe the present disclosure thoroughly and completely, and to fully disclose the scope of the present disclosure to a person having ordinary skill in the art. In the drawings, components are enlarged for clarity.

Transistors used in all embodiments of the present disclosure may be thin film transistors, field effect transistors or other devices with same characteristics. In an embodiment, a connection mode between a drain electrode and a source electrode of each transistor is interchangeable, and therefore the drain electrode and the source electrode in the embodiments of the present disclosure are indistinguishable. Herein, in order to distinguish two electrodes of a transistor apart from a gate electrode, one of the two electrodes can be referred to as the drain electrode, and the other of the two electrodes can be referred to as the source electrode. The thin film transistors used in the embodiments of the present disclosure can be N type transistors or P type transistors. In the embodiments of the present disclosure, in a case of using an N type thin film transistor, a first electrode of the N type thin film transistor may be the source electrode, and a second electrode of the N type thin film transistor may be the drain electrode. In the following embodiments, a thin film transistor is the N type thin film transistor, which is taken as an example for description simplicity, that is, in a case that a signal of the gate electrode is a high voltage level, the thin film transistor is turned on. It is understood that, in a case that a P type transistor is used, a time sequence of a drive signal needs to be adjusted accordingly.

Embodiments of the present disclosure can suppress noise in a gate driving circuit, and unlike other gate driving circuits, the gate driving circuit provided by the present disclosure uses a special circuit structure and can stably and continuously suppress the noise.

Figure 12:
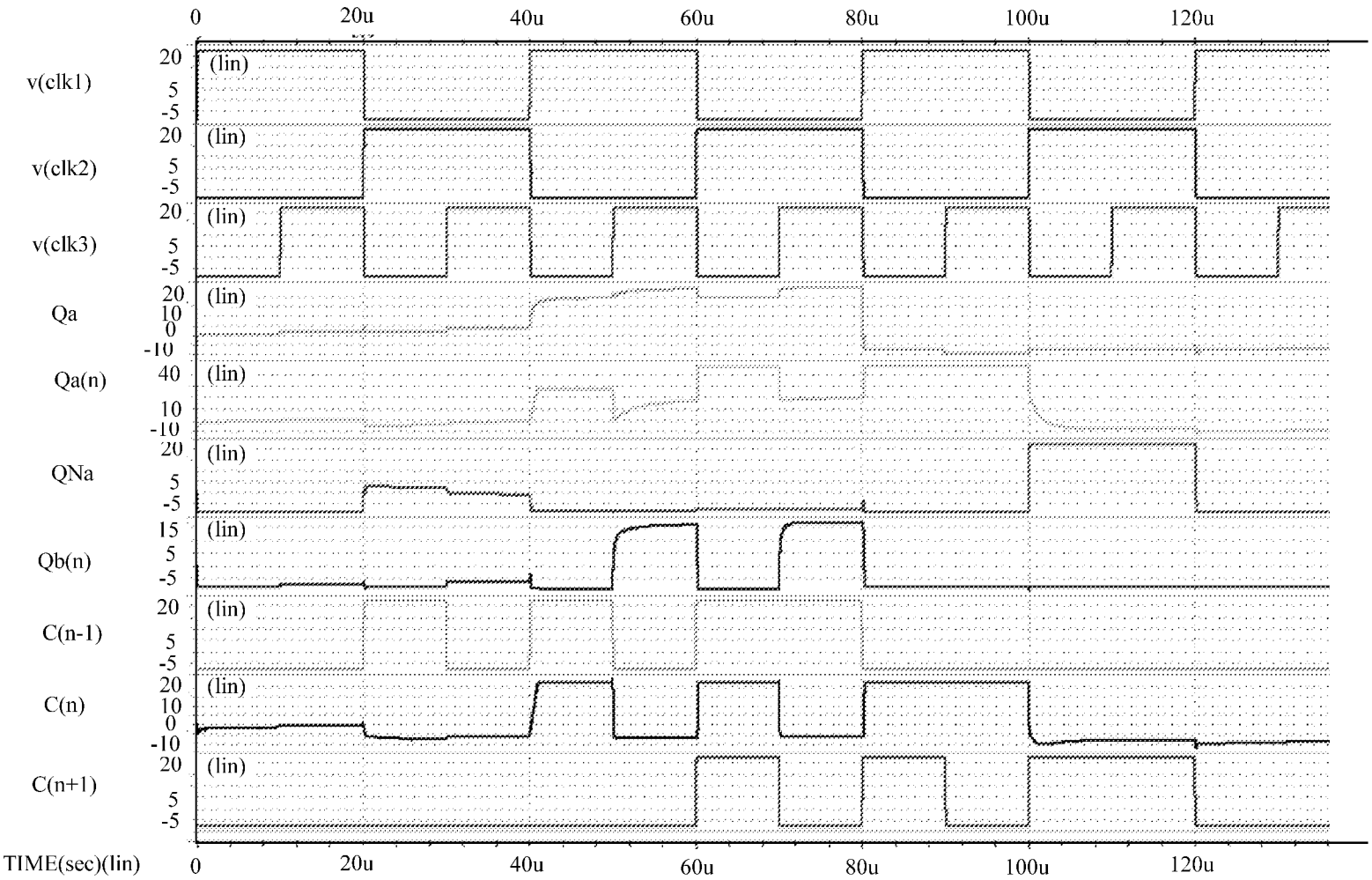
FIG. 12 shows a unit multi-pulse programmable simulation verification according to an embodiment of the present disclosure.
Figure 13:
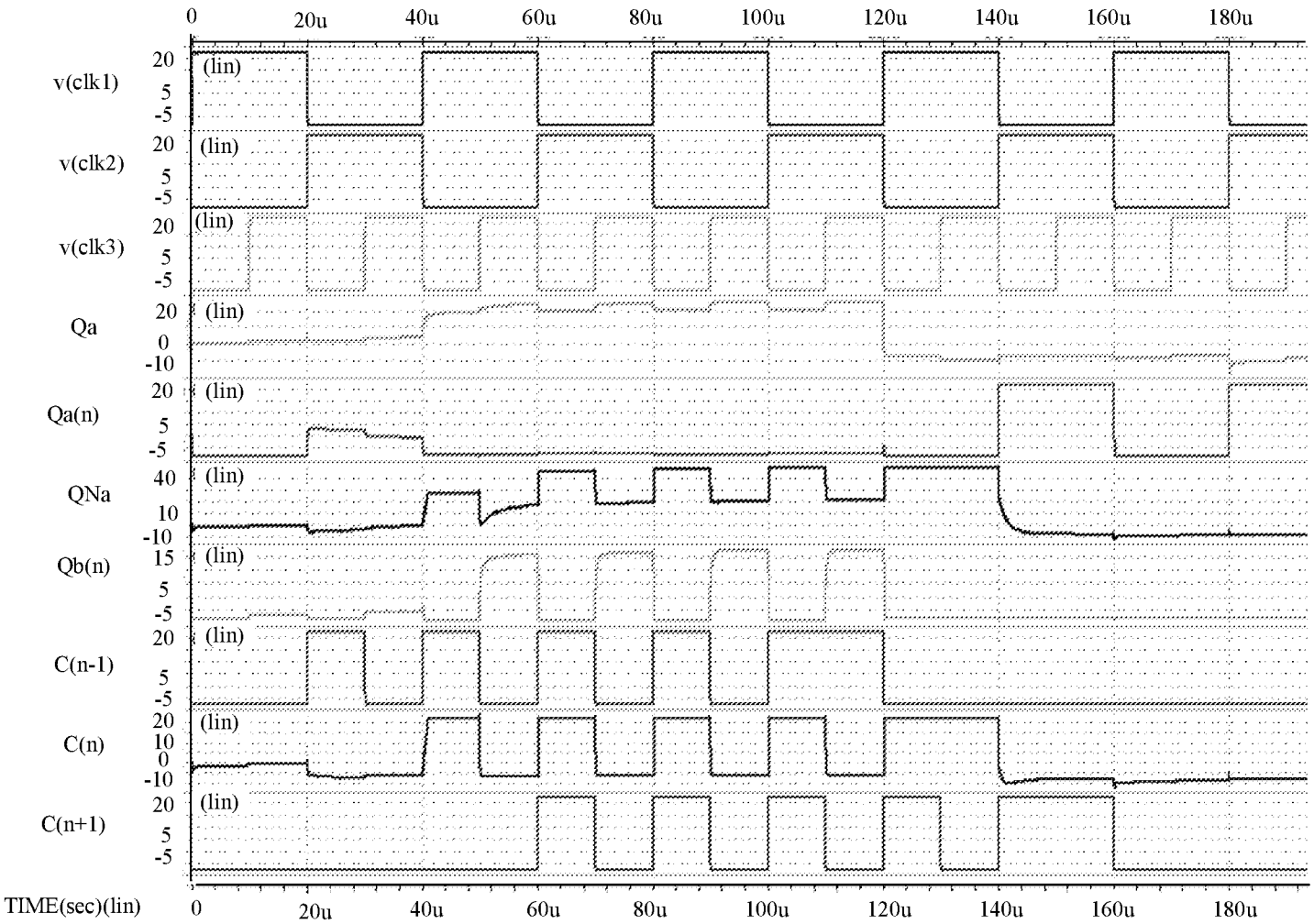
FIG. 13 shows a unit self-adaptive function simulation verification according to an embodiment of the present disclosure.

Embodiments of the present disclosure relate to a multi-pulse and programmable-pulse-width gate display circuit or gate driving circuit. An embodiment of the present disclosure comprises an input circuit, an output circuit, a pull-down circuit and control circuits. The input circuit comprises four thin film transistors (TFTs); two control circuits are included, one of the two control circuits outputs Qa(n), the other of the two control circuits outputs Qb(n); the pull-down circuit pulls down the Qa(n) node and C(n); the output circuit outputs the C(n). The present disclosure can achieve a function of a programmable multi-pulse gate driving unit, and meanwhile, the gate driving unit of the present disclosure can be self-adaptive to the number of initial pulses, that is, a working range is not limited by the number of the pulses, and details are shown in FIG. 12 and FIG. 13.

FIG. 1 shows a 3T2C (3 transistors and 2 capacitors) internal compensation circuit.

Figure 2:
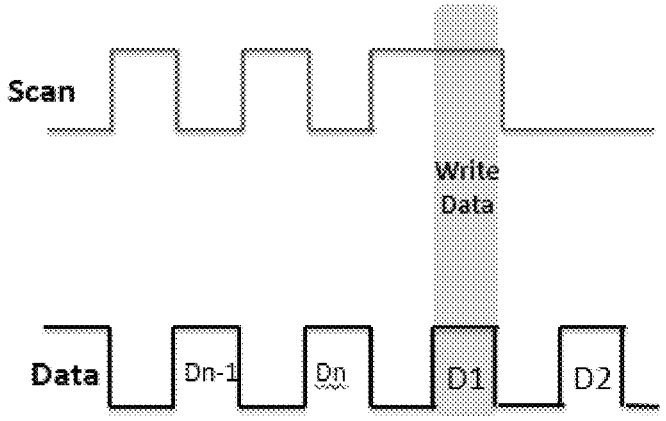
FIG. 2 shows a time sequence diagram of a scan signal of a 3T2C internal compensation circuit.

In FIG. 1, in order to obtain a more accurate threshold voltage Vth of a T1 transistor, a plurality of pulses are required for a scan signal, so as to increase charging at an S position, and at the same time, it is needed to extend a half clock to read data (Data). It can be seen, in OLED TV design, multi-pulse programmable gate driving plays a huge role. FIG. 2 shows a time sequence diagram of a scan signal of the 3T2C internal compensation circuit.

The gate driving according to an embodiment of the present disclosure uses a double-end control circuit to respectively control a first control node Qa(n) and a second control node Qb(n), so as to achieve a programmable purpose.

Figure 3:
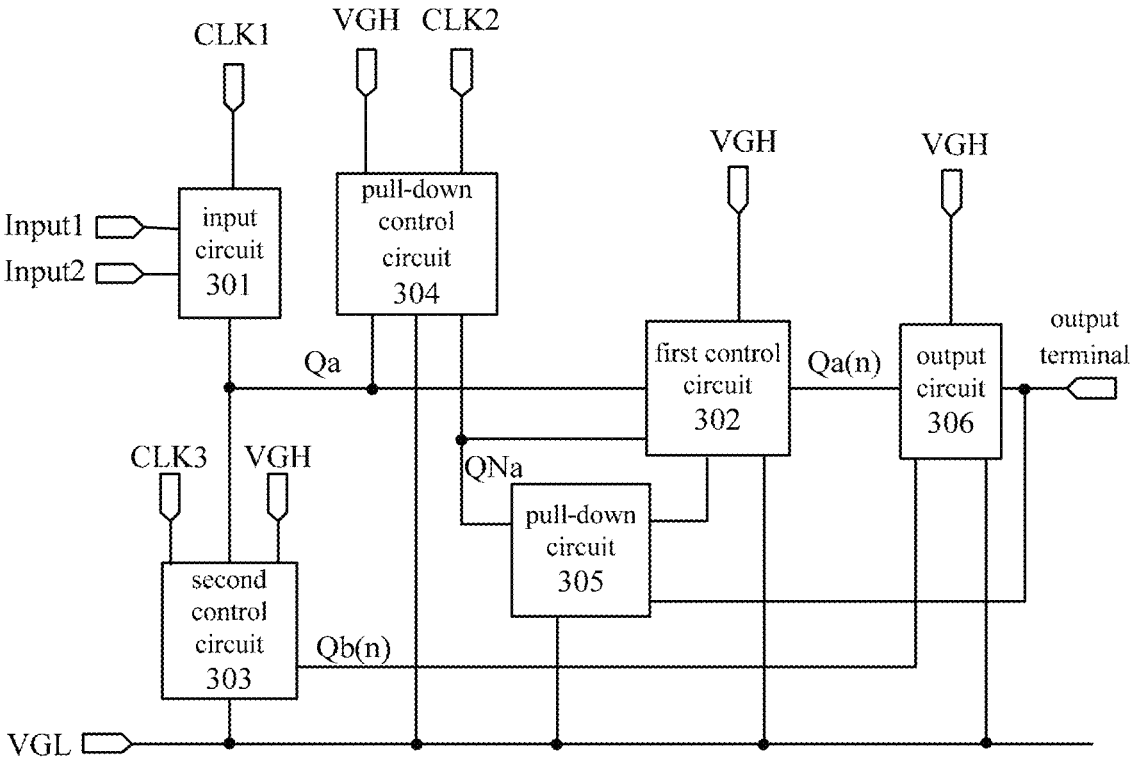
FIG. 3 shows a structural diagram of a gate driving unit according to an embodiment of the present disclosure.

FIG. 3 shows a structural diagram of a gate driving unit according to an embodiment of the present disclosure.

As shown in FIG. 3, as an aspect of an embodiment of the present disclosure, a gate driving unit is provided. The gate driving unit comprises an input circuit 301, a first control circuit 302, a second control circuit 303, a pull-down control circuit 304, a pull-down circuit 305 and an output circuit 306.

The input circuit 301 connects to a first clock terminal CLK1, a first input terminal Input1, a second input terminal Input2, and a pull-up node Qa. The first input terminal Input1 receives an output signal from an output terminal C(n−1) of a gate driving unit at a previous level, the second input terminal Input2 receives an output signal from an output terminal C(n+1) of a gate driving unit at a next level. The output circuit 301 is configured to transmit the output signal of the gate driving unit at the previous level to the pull-up node Qa in a case that one of the output terminal C(n−1) of the gate driving unit at the previous level and the output terminal C(n+1) of the gate driving unit at the next level is at an active voltage level, and the first clock terminal CLK1 is also at an active voltage level.

In some examples, the active voltage level is a voltage level at which a transistor is turned on. For example, for a P type transistor, the active voltage level is a low voltage level; for an N type transistor, the active voltage level is a high voltage level.

The first control circuit 302 connects to a first power voltage terminal VGH, the pull-up node Qa, a pull-down node QNa and the first control node Qa(n). The first control circuit 302 is configured to provide a first power voltage signal VGH to the first control node Qa(n) in a case that the pull-up node Qa is at an active voltage level.

The second control circuit 303 connects to a third clock terminal CLK3, the first power voltage terminal VGH, the second power voltage terminal VGL, the pull-up node Qa and the second control node Qb(n). The second control circuit 303 is configured to: provide a third clock signal of the third clock terminal CLK3 to the second control node Qb(n) in a case that the pull-up node Qa is at an active voltage level; and pull down the second control node Qb(n) to a second power voltage signal VGL in a case that the pull-up node Qa is at a non-active voltage level.

In some examples, the non-active voltage level is a voltage level at which a transistor is turned off. For example, for a P type transistor, the non-active voltage level is a high voltage level; for an N type transistor, the non-active voltage level is a low voltage level.

The pull-down control circuit 304 connects to a second clock terminal CLK2, the first power voltage terminal VGH, the second power voltage terminal VGL, the pull-up node Qa and the pull-down node QNa. The pull-down control circuit 304 is configured to control the pull-down circuit 305 whether to carry out operations or not by a pull-down signal at the pull-down node QNa. For example, the pull-down control circuit 304 generates the pull-down signal with a non-active voltage level at the pull-down node QNa in a case that a pull-up signal at the pull-up node Qa is at an active voltage level; and the pull-down control circuit 304 provides a second clock signal of the second clock terminal CLK2 to the pull-down node QNa in response to the first power voltage signal VGH in a case that the pull-up signal at the pull-up node Qa is at a non-active voltage level.

The pull-down circuit 305 connects to the pull-down node QNa, the first control circuit 302, the second power voltage terminal VGL and an output terminal. The pull-down circuit 305 is configured to pull down the output terminal and the first control node Qa(n) to the second power voltage terminal VGL in a case that the pull-down signal at the pull-down node QNa is at an active voltage level.

The output circuit 306 connects to the first power voltage terminal VGH, the second power voltage terminal VGL, the first control node Qa(n), the second control node Qb(n) and the output terminal. The output circuit 306 is configured to output the first power voltage signal of the first power voltage terminal VGH to the output terminal in a case that the first control node Qa(n) is at an active voltage level and the second control node Qb(n) is at a non-active voltage level.

For example, the first power voltage terminal VGH is a high power voltage terminal. The second power voltage terminal VGL is a low power voltage terminal.

Figure 4:
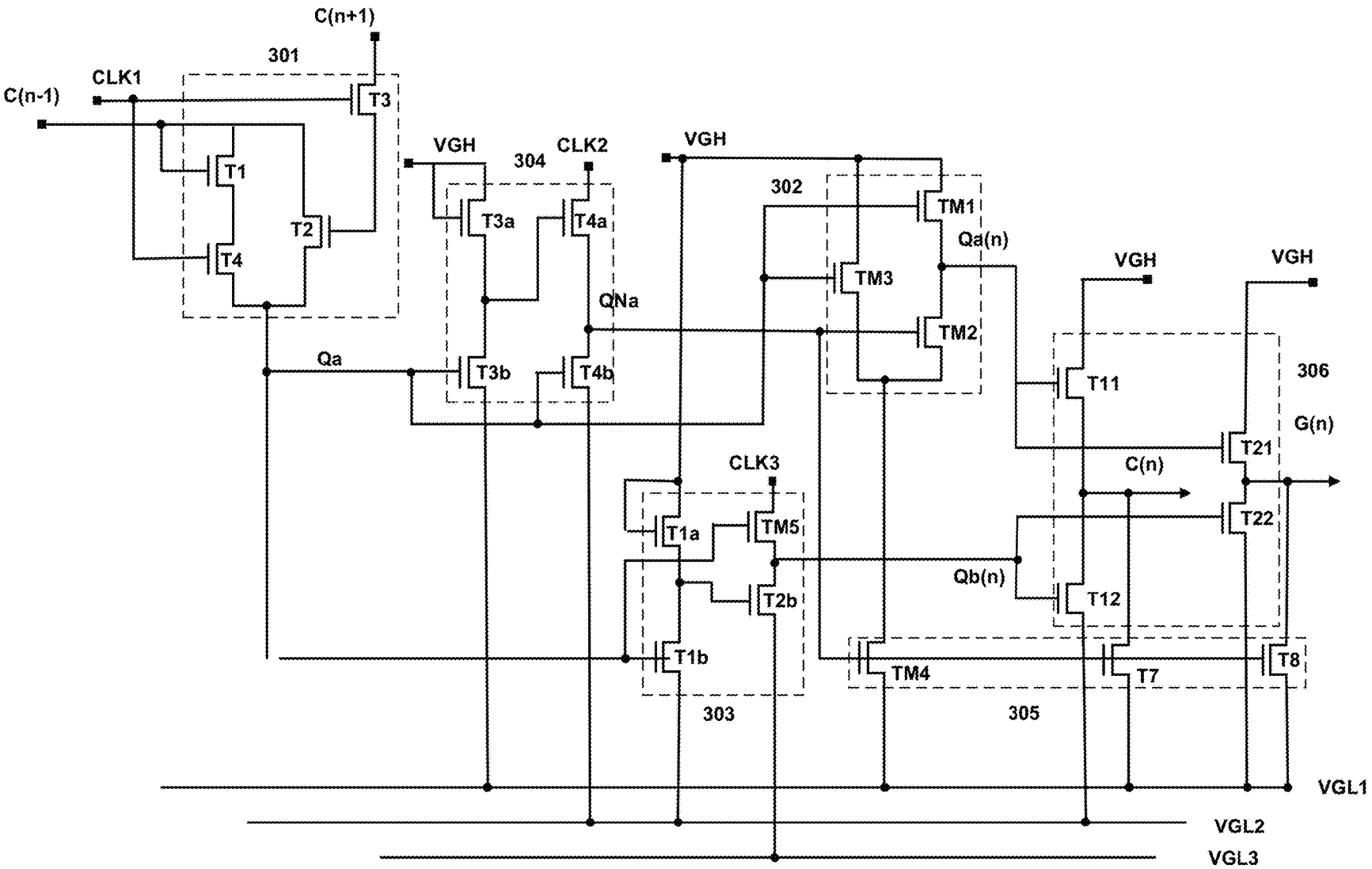
FIG. 4 shows a circuit schematic diagram of a gate driving unit according to a first embodiment of the present disclosure.

FIG. 4 shows a circuit schematic diagram of a gate driving unit according to a first embodiment of the present disclosure.

In the following, transistors in FIG. 4 are N type transistors that are turned on in a case of inputting a high voltage level to a gate electrode, which is taken as an example for illustration purpose.

As shown in FIG. 4, in an embodiment, for example, the input circuit 301 comprises first to fourth input transistors T1-T4.

A gate electrode and a first electrode of the first input transistor T1 are connected as a first input terminal to be connected to the output terminal C(n−1) of the previous-level gate driving unit, and a second electrode of the first input transistor T1 is connected to a first electrode of the fourth input transistor T4. A gate electrode of the second input transistor T2 is connected to a second electrode of the third input transistor T3, a first electrode of the second input transistor T2 is connected to the output terminal C(n−1) of the previous-level gate driving unit, and a second electrode of the second input transistor T2 is connected to the pull-up node Qa. A gate electrode of the third input transistor T3 is connected to the first clock terminal CLK1, and a first electrode of the third input transistor T3 serves as a second input terminal connected to the output terminal C(n+1) of the next-level gate driving unit. A gate electrode of the fourth input transistor T4 is connected to the first clock terminal CLK1, and a second electrode of the fourth input transistor T4 is connected to the pull-up node Qa.

A specific implementation structure, a control method and the like of the input circuit 301 do not constitute limitations to the embodiments of the present disclosure.

In an embodiment, for example, the first control circuit 302 comprises first to third control transistors TM1-TM3.

A gate electrode of the first control transistor TM1 is connected to the pull-up node Qa, a first electrode of the first control transistor TM1 is connected to the first power voltage terminal VGH, and a second electrode of the first control transistor TM1 is connected to the first control node Qa(n). A gate electrode of the second control transistor TM2 is connected to the pull-down node QNa, a first electrode of the second control transistor TM2 is connected to the first control node Qa(n), and a second electrode of the second control transistor TM2 is connected to the pull-down circuit 305. A gate electrode of the third control transistor TM3 is connected to the pull-up node Qa, a first electrode of the third control transistor TM3 is connected to the first power voltage terminal VGH, and a second electrode of the third control transistor TM3 is connected to the pull-down circuit 305.

The first control circuit 302 described above is merely an example, and may have other structures.

In an embodiment, for example, the second power voltage terminal VGL comprises a third power voltage terminal VGL1, a fourth power voltage terminal VGL2 and a fifth power voltage terminal VGL3.

In an embodiment, for example, the second control circuit 303 comprises a fourth control transistor TM5, a fifth control transistor T1*a*, a sixth control transistor T1*b* and a seventh control transistor T2*b*.

A gate electrode of the fourth control transistor TM5 is connected to the pull-up node Qa, a first electrode of the fourth control transistor TM5 is connected to the third clock terminal CLK3, and a second electrode of the fourth control transistor TM5 is connected to the second control node Qb(n). A gate electrode and a first electrode of the fifth control transistor T1*a* are connected to the first power voltage terminal VGH, and a second electrode of the fifth control transistor T1*a* is connected to a gate electrode of the seventh control transistor T2*b*. A gate electrode of the sixth control transistor T1*b* is connected to the pull-up node Qa, a first electrode of the sixth control transistor T1*b* is connected to the gate electrode of the seventh control transistor T2*b*, and a second electrode of the sixth control transistor T1*b* is connected to the fourth power voltage terminal VGL2. A first electrode of the seventh control transistor T2*b* is connected to the second control node Qb(n), and a second electrode of the seventh control transistor T2*b* is connected to the fifth power voltage terminal VGL3.

The second control circuit 303 is configured to: provide the third clock signal of the third clock terminal CLK3 to the second control node Qb(n) in a case that the pull-up node Qa is at an active voltage level; and pull down the second control node Qb(n) to the fifth power voltage terminal VGL3 in a case that the pull-up node Qa is at a non-active voltage level. The second control circuit 303 described above is merely an example, and may have other structures.

In an embodiment, for example, the pull-down control circuit 304 comprises a first pull-down control transistor T3*a*, a second pull-down control transistor T3*b*, a third pull-down control transistor T4*a* and a fourth pull-down control transistor T4*b*.

A gate electrode and a first electrode of the first pull-down control transistor T3*a* is connected to the first power voltage terminal VGH, and a second electrode of the first pull-down control transistor T3*a* is connected to a gate electrode of the third pull-down control transistor T4*a*. A gate electrode of the second pull-down control transistor T3*b* is connected to the pull-up node Qa, a first electrode of the second pull-down control transistor T3*b* is connected to the gate electrode of the third pull-down control transistor T4*a*, and a second electrode of the second pull-down control transistor T3*b* is connected to the third power voltage terminal VGL1. A first electrode of the third pull-down control transistor T4*a* is connected to the second clock terminal CLK2, and a second electrode of the third pull-down control transistor T4*a* is connected to the pull-down node QNa. A gate electrode of the fourth pull-down control transistor T4*b* is connected to the pull-up node Qa, a first electrode of the fourth pull-down control transistor T4*b* is connected to the pull-down node QNa, and a second electrode of the fourth pull-down control transistor T4*b* is connected to the fourth power voltage terminal VGL2.

In an embodiment, for example, the pull-down circuit 305 comprises a node pull-down transistor TM4, a first output pull-down transistor T7 and a second output pull-down transistor T8.

A gate electrode of the node pull-down transistor TM4 is connected to the pull-down node QNa, a first electrode of the node pull-down transistor TM4 is connected to the second electrode of the second control transistor TM2, and a second electrode of the node pull-down transistor TM4 is connected to the third power voltage terminal VGL1. A gate electrode of the first output pull-down transistor T7 and a gate electrode of the second output pull-down transistor T8 are connected to the pull-down node QNa, a first electrode of the first output pull-down transistor T7 is connected to a first output terminal C(n), a first electrode of the second output pull-down transistor T8 is connected to a second output terminal G(n), a second electrode of the first output pull-down transistor T7 and a second electrode of the second output pull-down transistor T8 are connected to the third power voltage terminal VGL1.

In a case that the pull-down signal at the pull-down node QNa is at an active voltage level, the node pull-down transistor TM4, the first output pull-down transistor T7 and the second output pull-down transistor T8 are turned on, and respectively pull down the pull-up node Qa, the first output terminal C(n) and the second output terminal G(n) to a power voltage of the third power voltage terminal VGL1.

The pull-down control circuit 304 and the pull-down circuit 305 described above are merely examples, and may have other structures.

In an embodiment, for example, the output terminal comprises: the first output terminal and the second output terminal. The output circuit 306 comprises a first output circuit and a second output circuit. The first output circuit comprises a first output transistor T11 and a second output transistor T12, and the second output circuit comprises a third output transistor T21 and a fourth output transistor T22.

A gate electrode of the first output transistor T11 is connected to the first control node Qa(n), a first electrode of the first output transistor T11 is connected to the first power voltage signal VGH, and a second electrode of the first output transistor T11 is connected to the first output terminal C(n). A gate electrode of the second output transistor T12 is connected to the second control node Qb(n), a first electrode of the second output transistor T12 is connected to the first output terminal C(n), and a second electrode of the second output transistor T12 is connected to the fourth power voltage terminal VGL2. A gate electrode of the third output transistor T21 is connected to the first control node Qa(n), a first electrode of the third output transistor T21 is connected to the first power voltage signal VGH, and a second electrode of the third output transistor T21 is connected to the second output terminal G(n). A gate electrode of the fourth output transistor T22 is connected to the second control node Qb(n), a first electrode of the fourth output transistor T22 is connected to the second output terminal G(n), and a second electrode of the fourth output transistor T22 is connected to the third power voltage terminal VGL1.

The output circuit 306 described above is merely an example, and may have other structures.

For example, a third power voltage signal VGL1 is larger than a fourth power voltage signal VGL2, and the fourth power voltage signal VGL2 is larger than a fifth power voltage signal VGL3. The gate driving unit shown in FIG. 4 uses low power voltage terminals with different voltage levels, so as to be more suitable for an IGZO (OLED panel) oxide backplane, but a person having ordinary skill in the art should understand that the low power voltage terminals with an identical voltage level or other numbers of the low power voltage terminals may also be adopted.

Figure 5:
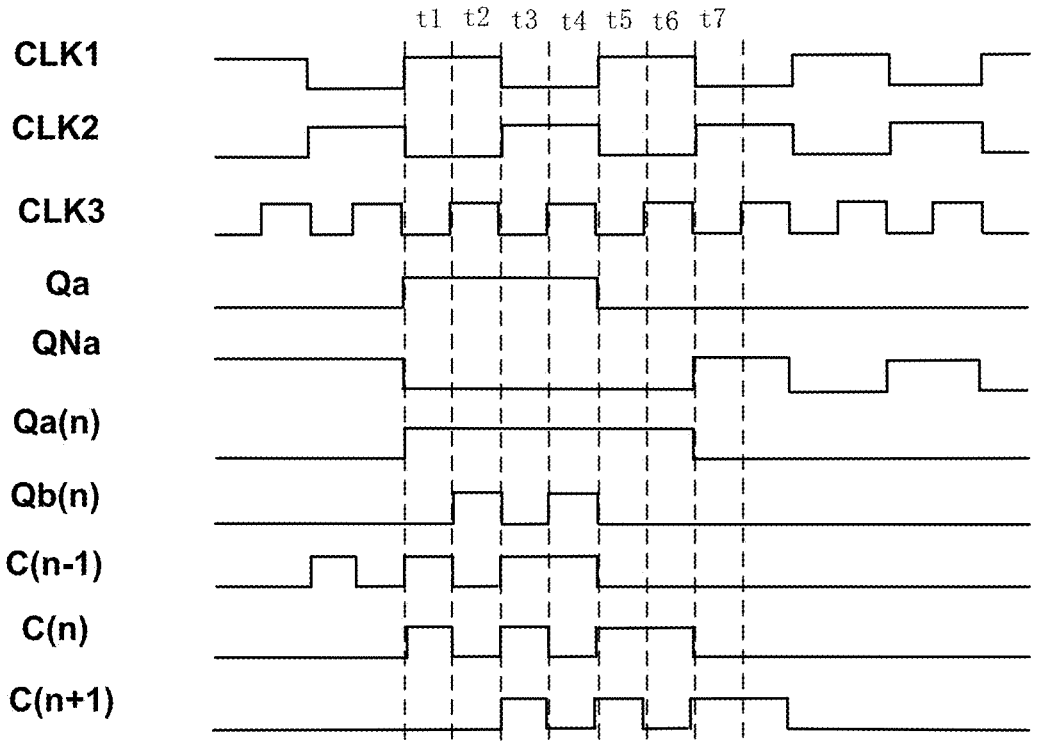
FIG. 5 shows a time sequence state diagram of respective signals in a gate driving unit provided by an embodiment of the present disclosure.

FIG. 5 shows a time sequence state diagram of respective signals in a gate driving unit provided by a first embodiment of the present disclosure.

With reference to the time sequence state schematic diagram shown in FIG. 5, a working principle of the gate driving unit shown in FIG. 4 will be described below. For example, transistors in a circuit shown in FIG. 4 are N type transistors, which is taken as an example to illustrate.

FIG. 5 shows time sequence states of a first clock signal input by the first clock terminal CLK1, a second clock signal input by the second clock terminal CLK2, a third clock signal input by the third clock terminal CLK3, a voltage of the pull-up node Qa, a voltage of the pull-down node QNa, a voltage of the first control node Qa(n), a voltage of the second control node Qb(n), an output signal output from the previous-level output terminal C(n−1), an output signal output from a present-level output terminal C(n) and an output signal output from a next-level output terminal C(n+1).

As shown in FIG. 5, seven stages of the time sequence state are provided. For example, a first stage is t1; a second stage is t2; a third stage is t3; a fourth stage is t4; a fifth stage is t5; a sixth stage is t6; and a seventh stage is t7.

In the t1 stage, the CLK1 and the C(n−1) are at a high voltage level, and the CLK2, CLK3 and C(n+1) are at a low voltage level. In this stage, because the CLK1 and the C(n−1) are at the high voltage level, the T1, T4 and T3 are turned on, and a high voltage level of the C(n−1) is transmitted to the Qa through the T1 and T4. Meanwhile, because the C(n+1) is at the low voltage level, the T2 is turned off, a voltage of the Qa rises, the T3*b* and T4*b* are turned on, the turned on T3*b* causes the T4*a* to be turned off, and a voltage of the QNa is pulled down to a low voltage level VGL2 through the T4*b*. In addition, in this stage, because the Qa is at a high voltage level and the QNa is at a low voltage level, the TM1 is turned on and the TM2 is turned off, and a high level VGH is transmitted to the Qa(n) through the TM1. The Qa is at the high voltage level and because the CLK3 is at the low voltage level, therefore the Qb(n) is pulled down to a low voltage level through the turned-on TM5. In this stage, the T11 is turned on by the Qa(n) with a high voltage level, and the T12 is turned off by the Qb(n) with a low voltage level, so that the high voltage level VGH is transmitted to the first output terminal through the T11, and the first output terminal C(n) is at a high voltage level. The T21 is turned on by the Qa(n) with the high voltage level, and the T22 is turned off by the Qb(n) with the low voltage level, so that the high voltage level VGH is transmitted to the second output terminal through the T21, and the second output terminal G(n) is at a high voltage level.

In the t2 stage, the CLK1 and the CLK3 are at a high voltage level, and the CLK2, the C(n−1) and the C(n+1) are at a low voltage level. In this stage, because the C(n−1) and the C(n+1) are at the low voltage level, the T2 and the T1 are turned off, and the Qa is still kept at the high voltage level. Because the Qa is kept at the high voltage level, the T3*b* and T4*b* are turned on. The T3*b* is turned on so that the T4*a* is turned off, and the voltage of the QNa is pulled down to the low voltage level VGL2 by the turned-on T4*b*. In addition, in this stage, because the Qa is at the high voltage level and the QNa is at a low voltage level, the TM1 is turned on and the TM2 is turned off, and the Qa(n) continues to be kept at the high voltage level. The Qa is at the high voltage level and because the CLK3 is at the high voltage level, therefore the Qb(n) is pulled up to the high voltage level CLK3 by the turned-on TM5. In this stage, the T12 is turned on by the Qb(n) with a high voltage level, so that the first output terminal is pulled down to the VGL2 by the turned-on T12, and the first output terminal C(n) is at a low voltage level. The T22 is turned on by the Qb(n) with a high voltage level, so that the second output terminal is pulled down to the VGL1 by the turned-on T22, and the second output terminal G(n) is at a low voltage level.

In the stage t3, the CLK2, the C(n+1) and the C(n−1) are at a high voltage level, and the CLK1 and the CLK3 are at a low voltage level. In this stage, because the CLK1 is at the low voltage level, the T3 and T4 are turned off, and the Qa is still kept at a high voltage level. Because the Qa is kept at the high voltage level, the T3*b* and the T4*b* are turned on, the turned-on T3*b* causes the T4*a* to be turned off, and the voltage of the QNa is pulled down to the low voltage level VGL2 by the turned-on T4*b*. In addition, in this stage, because the Qa is at the high voltage level and the QNa is at a low voltage level, the TM1 is turned on and the TM2 is turned off, the Qa(n) continues to be kept at the high voltage level. The Qa is at the high voltage level and because the CLK3 is at the low voltage level, therefore the Qb(n) is pulled down to a low voltage level CLK3 by the turned-on TM5. In this stage, the T11 is turned on by the Qa(n) with a high voltage level, and the T12 is turned off by the Qb(n) with a low voltage level, so that the high voltage level VGH is transmitted to the first output terminal through the T11, and the first output terminal C(n) is at a high voltage level. The T21 is turned on by the Qa(n) with the high voltage level, and the T22 is turned off by the Qb(n) with the low voltage level, so that the high voltage level VGH is transmitted to the second output terminal through the T21, and the second output terminal G(n) is at a high voltage level.

In the t4 stage, the CLK2, the C(n−1) and the CLK3 are at a high voltage level, and the CLK1 and the C(n+1) are at a low voltage level. In this stage, because the CLK1 is at the low voltage level, the T3 and the T4 are turned off, and the Qa is still kept at a high voltage level. Because the Qa is kept at the high voltage level, the T3*b* and the T4*b* are turned on, the turned-on T3*b* causes the T4*a* to be turned off, and the voltage of the QNa is pulled down to the low voltage level VGL2 by the turned-on T4*b*. In addition, in this stage, because the Qa is at the high voltage level and the QNa is at a low voltage level, the TM1 is turned on and the TM2 is turned off, the Qa(n) continues to be kept at the high voltage level. The Qa is at the high voltage level and because the CLK3 is at the high voltage level, therefore the Qb(n) is pulled up to a high voltage level CLK3 by the turned-on TM5. In this stage, the T12 is turned on by the Qb(n) with a high voltage level, so that the first output terminal is pulled down to the VGL2 by the turned-on T12, and the first output terminal C(n) is at a low voltage level. The T22 is turned on by the Qb(n) with the high voltage level, so that the second output terminal is pulled down to VGL1 by the turned-on T22, and the second output terminal G(n) is at a low voltage level.

In the t5 stage, the CLK1 and the C(n+1) are at a high voltage level, and the CLK2, the C(n−1) and the CLK3 are at a low voltage level. In this stage, because the CLK1 is at the high voltage level, the T3 is turned on, the C(n+1) with a high voltage level is transmitted to the gate electrode of the T2 through the turned-on T3, so that the T2 is turned on, and the C(n−1) with a low voltage level pulls down the Qa to a low voltage level by the turned-on T2. Because the Qa is at a low voltage level, the T3 and T4 are turned off. Because the CLK2 is at the low voltage level, the voltage of the QNa is pulled down to a low voltage level by the turned-on T4*a*, the Qa is at the low voltage level, so that the TM5 and the T1*b* are turned off. The T2*b* is turned on by the high voltage level VGH from the turned-on T1*a*, and therefore the Qb(n) is pulled down to the low voltage level VGL3 by the turned-on T2*b*. In addition, in this stage, because the Qa and the QNa are at the low voltage level, the TM1 and the TM2 are turned off, and the Qa(n) is still kept at the high voltage level. In this stage, the T11 is turned on by the Qa(n) with a high voltage level, and the T12 is turned off by the Qb(n) with a low voltage level, so that the high voltage level VGH is transmitted to the first output terminal through the T11, and the first output terminal C(n) is at the high voltage level. The T21 is turned on by the Qa(n) with the high voltage level, and the T22 is turned off by the Qb(n) with the low voltage level, so that the high voltage level VGH is transmitted to the second output terminal through the T21, and the second output terminal G(n) is at a high voltage level.

In the t6 stage, the CLK1 and the CLK3 are at a high voltage level, and the CLK2, the C(n−1) and the C(n+1) are at a low voltage level. In this stage, because the CLK1 is at the high voltage level, the T3 is turned on, and the C(n+1) with a low voltage level is transmitted to the gate electrode of the T2 through the turned-on T3, so that the T2 is turned off. The C(n−1) is at the low voltage level, so that the T1 is turned off, and the Qa is kept at a low voltage level. Because the Qa is at the low voltage level, the T3*b* and the T4*b* are turned off. Because the CLK2 is at the low voltage level, the voltage of the QNa is pulled down to a low voltage level by the turned-on T4*a*. The Qa is at the low voltage level, so that the TM5 and the T1*b* are turned off, the T2*b* is turned on by the high voltage level VGH from the turned-on T1*a*, and so the Qb(n) is pulled down to the low voltage level VGL3 by the turned-on T2*b*. In addition, in this stage, because the Qa and the QNa are at the low voltage level, the TM1 and the TM2 are turned off, and the Qa(n) is still kept at the high voltage level. In this stage, the T11 is turned on by the Qa(n) with a high voltage level, and the T12 is turned off by the Qb(n) with a low voltage level, so that the high voltage level VGH is transmitted to the first output terminal through the T11, and the first output terminal C(n) is at a high voltage level. The T21 is turned on by the Qa(n) with the high voltage level, and the T12 is turned off by the Qb(n) with the low voltage level, so that the high voltage level VGH is transmitted to the second output terminal through the T21, and the second output terminal G(n) is at a high voltage level.

In the t7 stage, the CLK2 and the C(n+1) are at a high voltage level, and the CLK1, the CLK3 and the C(n−1) are at a low voltage level. In this stage, because the CLK1 is at the low voltage level, the T3 and the T4 are turned off, and the Qa continues to be kept at a low voltage level. Because the Qa is at the low voltage level, the T3*b* and the T4*b* are turned off. Because the CLK2 is at the high voltage level, the voltage of the QNa is pulled up to a high voltage level by the turned-on T4*a*. The Qa is at the low voltage level, so that the TM5 and the T1*b* are turned off. The T2*b* is turned on by the high voltage level VGH from the turned-on T1*a*, and so the Qb(n) is pulled down to the low voltage level VGL3 by the turned-on T2*b*. In addition, in this stage, because the QNa is at a high voltage level, the TM2, the TM4 and the T7 are turned on, and the Qa(n), the first output terminal C(n) and the second output terminal G(n) are pulled down to the third power voltage VGL1.

Further, all of the transistors in the gate driving unit in the above mentioned embodiments may also be P-type transistors that are turned on by a low voltage level. If all of the transistors are P type transistors, only the time sequence states of respective input signals of an inverter needs to be readjusted.

Furthermore, the above-mentioned gate driving unit may also use N-type transistors and P type transistors at the same time. In this case, it only needs to be ensured that the transistors in the gate driving unit controlled by a same time sequence signal or voltage needs to be of a same type; certainly, these are all reasonable alternative solutions that can be made by a person having ordinary skill in the art according to the embodiment(s) of the present disclosure and should therefore all fall within the protection scope of the present disclosure. However, considering a manufacturing process of the transistors, because active-layer doping materials of different types of the transistors are different, the same type of the transistors is used in the gate driving circuit, which is beneficial for simplifying the manufacturing process of the gate driving circuit.

Figure 6:
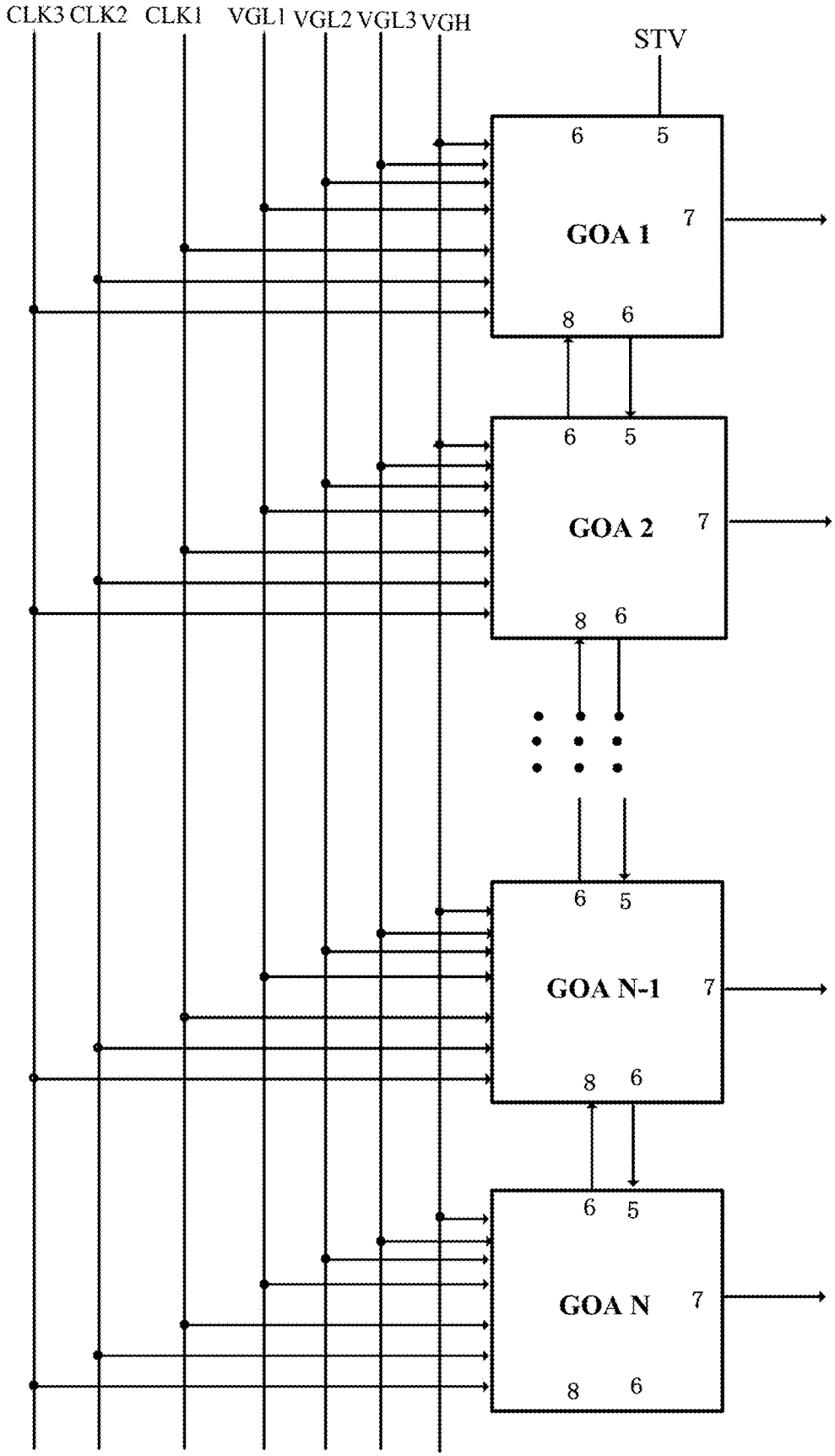
FIG. 6 shows a whole structure of a gate driving circuit according to a first embodiment of the present disclosure.

FIG. 6 shows a whole structure of a gate driving circuit according to a first embodiment of the present disclosure.

Figure 7:
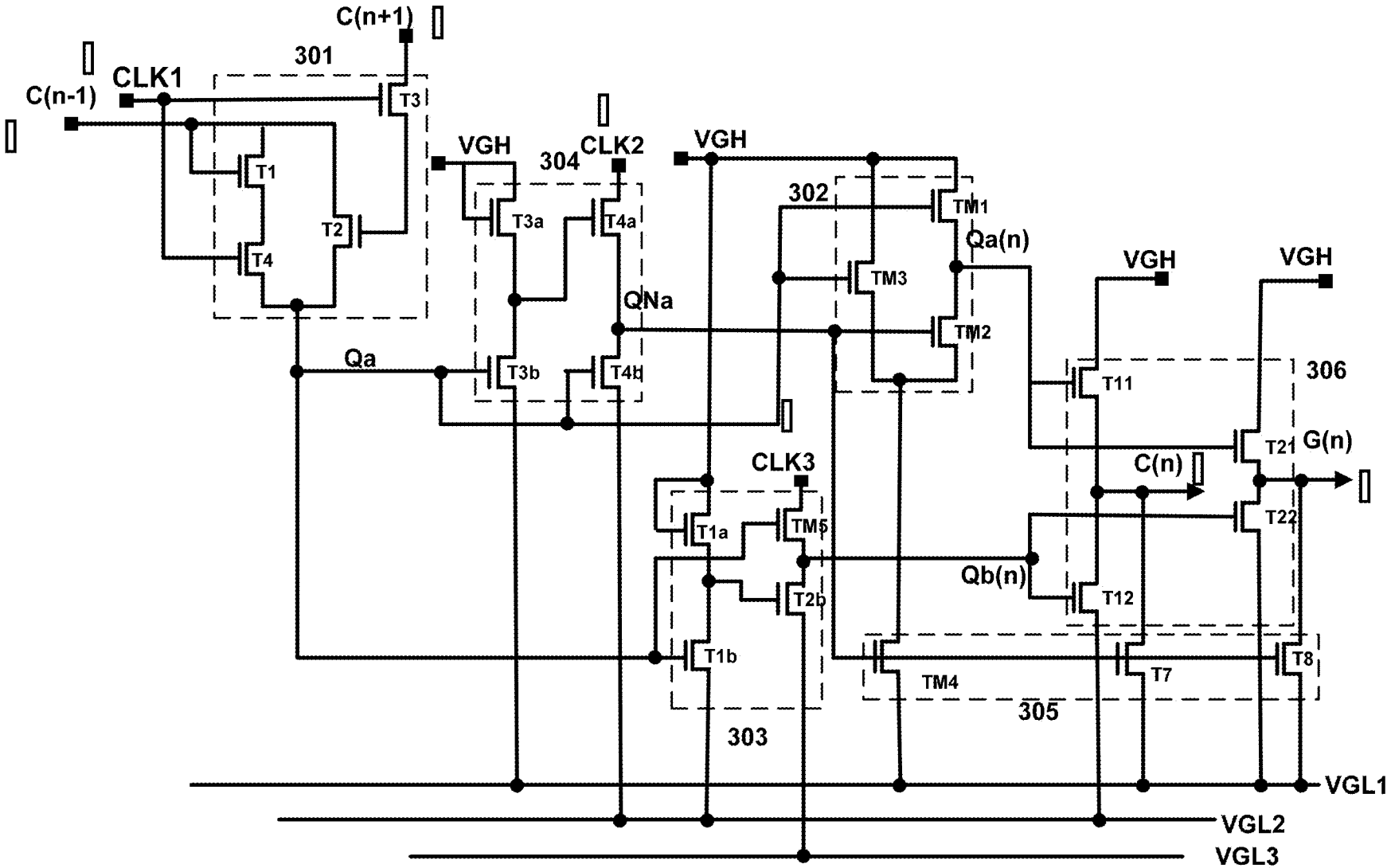
FIG. 7 shows definitions of respective terminals of a gate driving unit according to a first embodiment of the present disclosure.

FIG. 7 shows definitions of respective terminals of a gate driving unit according to a first embodiment of the present disclosure.

A gate driving circuit shown in FIG. 6 comprises N gate driving circuits connected in cascade, and the N gate driving units comprises a first gate driving unit to an Nth gate driving unit, and N is an integer greater than or equal to 2. Each gate driving unit may adopt the structure described above.

For example, in the cascaded N gate driving units, a first signal input terminal of the first gate driving unit is connected to a frame start signal, and a second signal input terminal of the Nth gate driving unit is connected to the frame start signal;

the first signal input terminal of each of the second to Nth gate driving units is connected to an output terminal of a previous-level gate driving unit adjacent thereto;

the second signal input terminal of each of the first to (N−1)th gate driving units is connected to an output terminal of a next-level gate driving unit adjacent thereto; and a drive signal output terminal of each gate driving unit is connected to a gate line.

The gate driving circuit mentioned above is configured to sequentially output scan signals to corresponding gate lines by connecting the drive signal output terminals of respective gate driving units to the corresponding gate lines.

Each gate driving unit comprises a first clock terminal CLK1, a second clock terminal CLK2, a third clock terminal CLK3, a first power voltage terminal VGH, a third power voltage terminal VGL1, a fourth power voltage terminal VGL2, and a fifth power voltage terminal VGL3.

The first clock terminal CLK1 of each gate driving unit inputs a first clock signal CLK1, the second clock terminal CLK2 inputs a second clock signal CLK2, and the third clock terminal CLK3 inputs a third clock signal CLK3. The first clock signal of the first clock terminal and the second clock signal of the second clock terminal are opposite in phase and have a same frequency, and a frequency of the third clock signal of the third clock terminal is twice of a frequency of the first clock signal of the first clock terminal.

Figure 8:
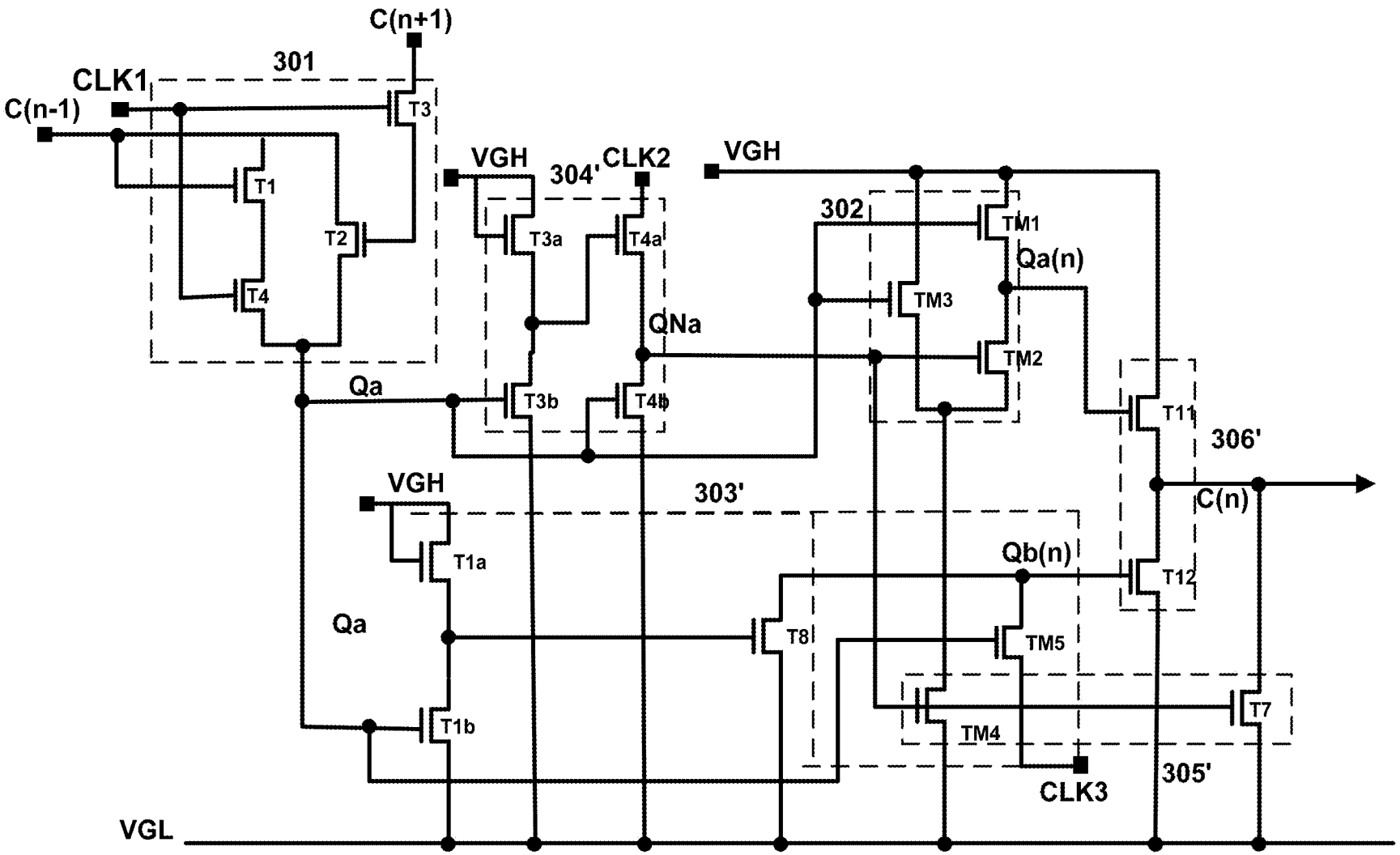
FIG. 8 shows a circuit schematic diagram of a gate driving unit according to a second embodiment of the present disclosure.

FIG. 8 shows a circuit schematic diagram of a gate driving unit according to a second embodiment of the present disclosure.

As shown in FIG. 8, differences between the gate driving unit shown in FIG. 8 and the gate driving unit shown in FIG. 4 comprise: replacing a pull-down control circuit 304 with a pull-down control circuit 304', replacing a second control circuit 303 with a second control circuit 303', replacing a pull-down circuit 305 with a pull-down circuit 305', and replacing an output circuit 306 with an output circuit 306'.

As shown in FIG. 8, specifically, in an embodiment, for example, the pull-down control circuit 304' comprises a first pull-down control transistor T3*a*, a second pull-down control transistor T3*b*, a third pull-down control transistor T4*a* and a fourth pull-down control transistor T4*b*.

A gate electrode and a first electrode of the first pull-down control transistor T3*a* are connected to the first power voltage terminal VGH, and a second electrode of the first pull-down control transistor T3*a* is connected to a gate electrode of the third pull-down control transistor T4*a*. A gate electrode of the second pull-down control transistor T3*b* is connected to the pull-up node Qa, a first electrode of the second pull-down control transistor T3*b* is connected to the gate electrode of the third pull-down control transistor T4*a*, and a second electrode of the second pull-down control transistor T3*b* is connected to the second power voltage terminal VGL. A first electrode of the third pull-down control transistor T4*a* is connected to the second clock terminal CLK2, and a second electrode of the third pull-down control transistor T4*a* is connected to the pull-down node QNa. A gate electrode of the fourth pull-down control transistor T4*b* is connected to the pull-up node Qa, a first electrode of the fourth pull-down control transistor T4*b* is connected to the pull-down node QNa, and a second electrode of the fourth pull-down control transistor T4*b* is connected to the second power voltage terminal VGL.

The second control circuit 303' comprises a fourth control transistor TM5, a fifth control transistor T1*a*, a sixth control transistor T1*b* and a seventh control transistor T8.

A gate electrode of the fourth control transistor TM5 is connected to the pull-up node Qa, a first electrode of the fourth control transistor TM5 is connected to the third clock terminal CLK3, and a second electrode of fourth control transistor TM5 is connected to the second control node Qb(n). A gate electrode and a first electrode of the fifth control transistor T1*a* are connected to the first power voltage terminal VGH, and a second electrode of the fifth control transistor T1*a* is connected to a gate electrode of the seventh control transistor T8. A gate electrode of the sixth control transistor T1*b* is connected to the pull-up node Qa, a first electrode of the sixth control transistor T1*b* is connected to the gate electrode of the seventh control transistor T8, and a second electrode of the sixth control transistor T1*b* is connected to the second power voltage terminal VGL. A first electrode of the seventh control transistor T8 is connected to the second control node Qb(n), and a second electrode of the seventh control transistor T8 is connected to the second power voltage terminal VGL. The second control circuit 303' is configured to: provide the third clock signal of the third clock terminal CLK3 to the second control node Qb(n) in a case that the pull-up node Qa is at an active voltage level; and pull down the second control node Qb(n) to the second power voltage terminal VGL in a case that the pull-up node Qa is at a non-active voltage level. The second control circuit 303' described above is merely an example, and may have other structures.

The pull-down circuit 305' comprises a node pull-down transistor TM4 and an output pull-down transistor T7. A gate electrode of the node pull-down transistor TM4 is connected to the pull-down node QNa, a first electrode of the node pull-down transistor TM4 is connected to the second electrode of the second control transistor TM2, and a second electrode of the node pull-down transistor TM4 is connected to the second power voltage terminal VGL. A gate electrode of the output pull-down transistor T7 is connected to the pull-down node QNa, a first electrode of the output pull-down transistor T7 is connected to the output terminal C(n), and a second electrode of the output pull-down transistor T7 is connected to the second power voltage terminal VGL.

In a case that the pull-down signal at the pull-down node QNa is at an active voltage level, the node pull-down transistor TM4 and the output pull-down transistor T7 are turned on, and respectively pull down the pull-up node Qa and the output terminal C(n) to a power voltage of the second power voltage terminal VGL. The pull-down circuit 305' described above is merely an example, and may have other structures.

The output circuit 306' comprises a first output transistor T11 and a second output transistor T12. A gate electrode of the first output transistor T11 is connected to the first control node Qa(n), a first electrode of the first output transistor T11 is connected to the first power voltage signal VGH, and a second electrode of the first output transistor T11 is connected to the output terminal C(n). A gate electrode of the second output transistor T12 is connected to the second control node Qb(n), a first electrode of the second output transistor T12 is connected to the output terminal C(n), and a second electrode of the second output transistor T12 is connected to the second power voltage terminal VGL. A voltage signal of the first power voltage terminal VGH is output to the signal output terminal, in a case that the first control node Qa(n) is at an active voltage level and the second control node Qb(n) is at a non-active voltage level.

The output circuit 306' described above is merely an example, and may have other structures.

Figure 9:
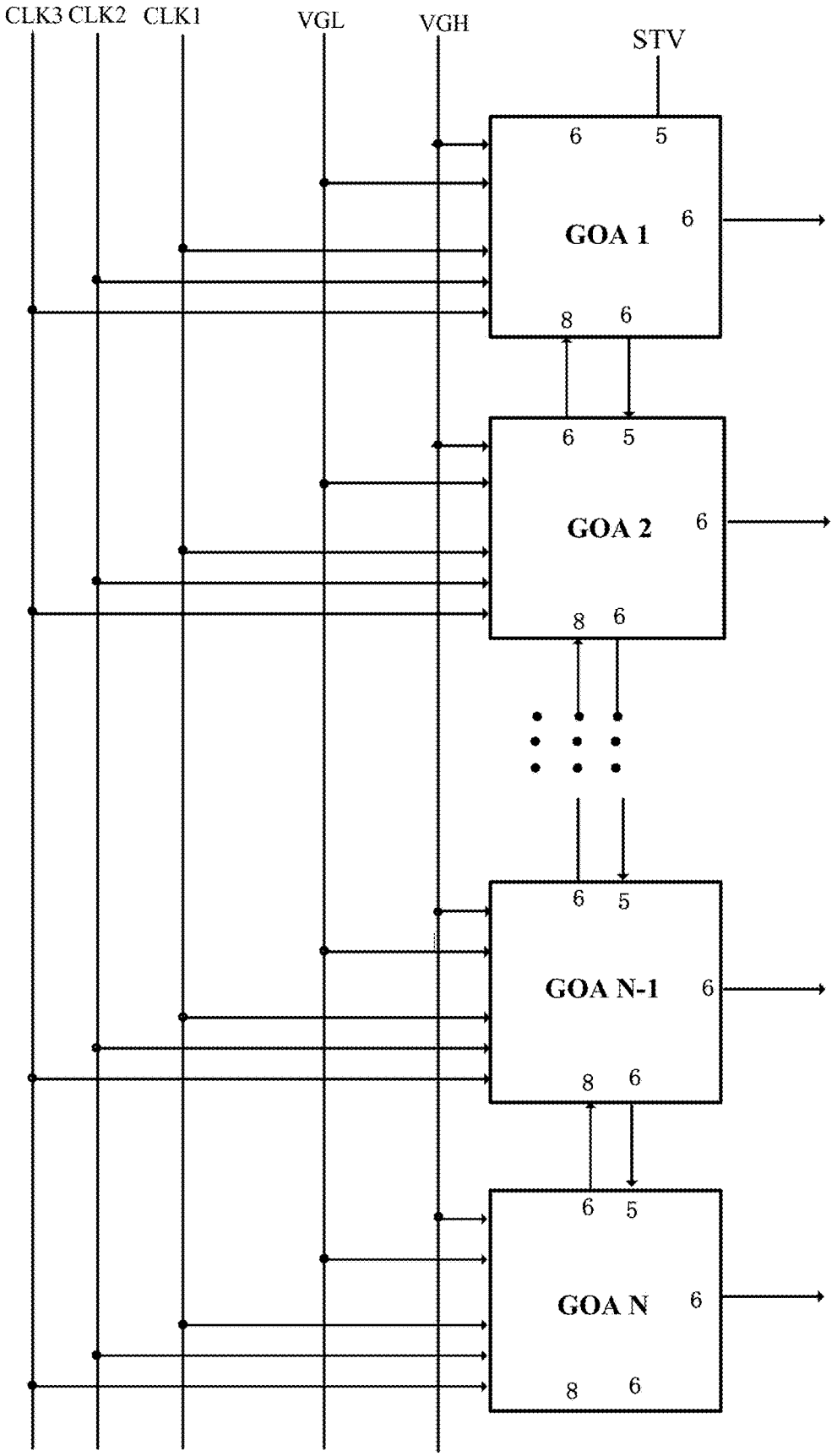
FIG. 9 shows a whole structure of a gate driving circuit according to a second embodiment of the present disclosure.

FIG. 9 shows a whole structure of a gate driving circuit according to a second embodiment of the present disclosure.

Figure 10:
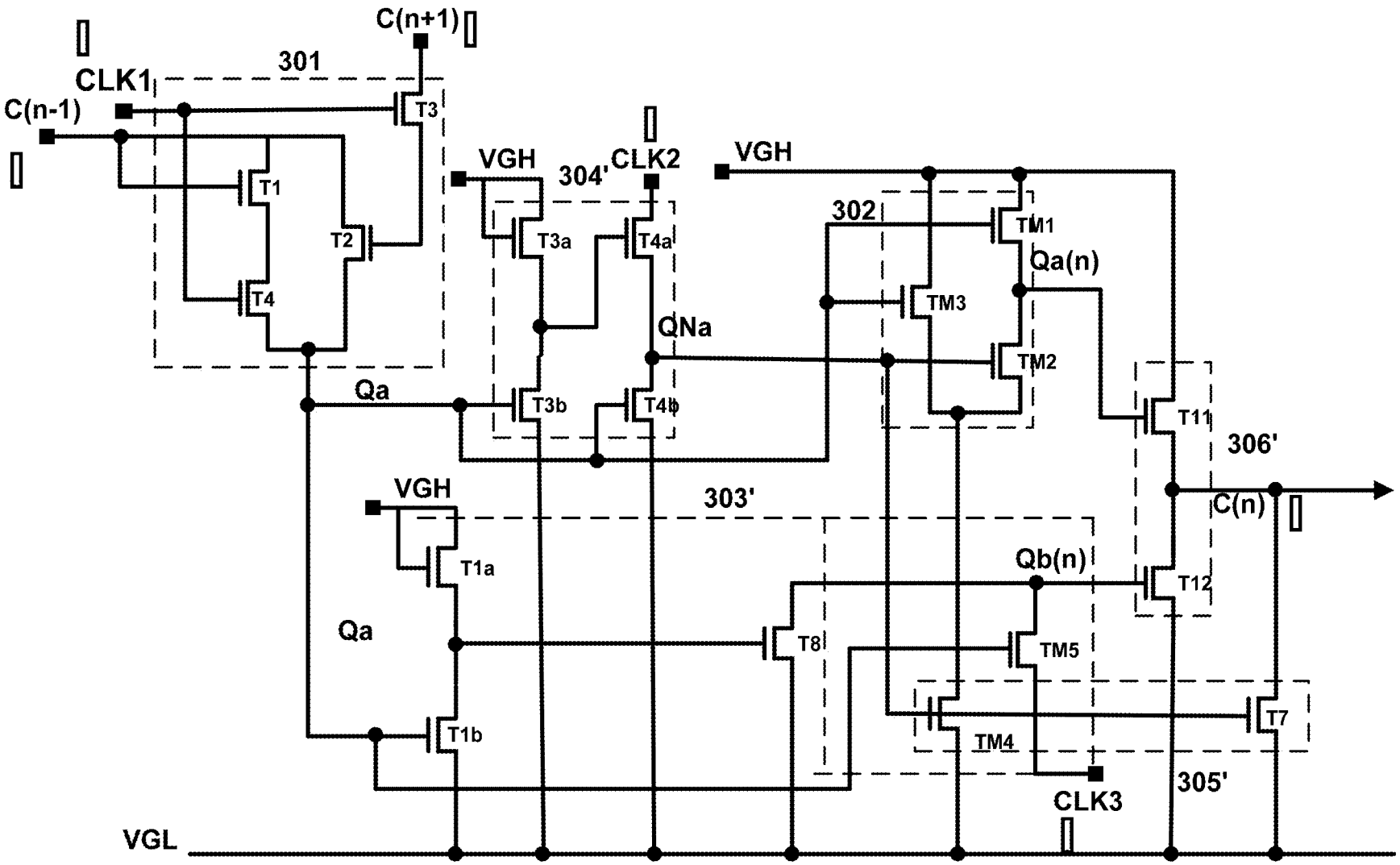
FIG. 10 shows definitions of respective terminals of a gate driving unit according to a second embodiment of the present disclosure.

FIG. 10 shows definitions of respective terminals of a gate driving unit according to a second embodiment of the present disclosure.

A gate driving circuit shown in FIG. 9 is similar to that shown in FIG. 6, differences between them include that the third power voltage terminal VGL1, the fourth power voltage terminal VGL2 and the fifth power voltage terminal VGL3 in FIG. 6 are replaced by the second power voltage terminal VGL in FIG. 9.

Figure 11:
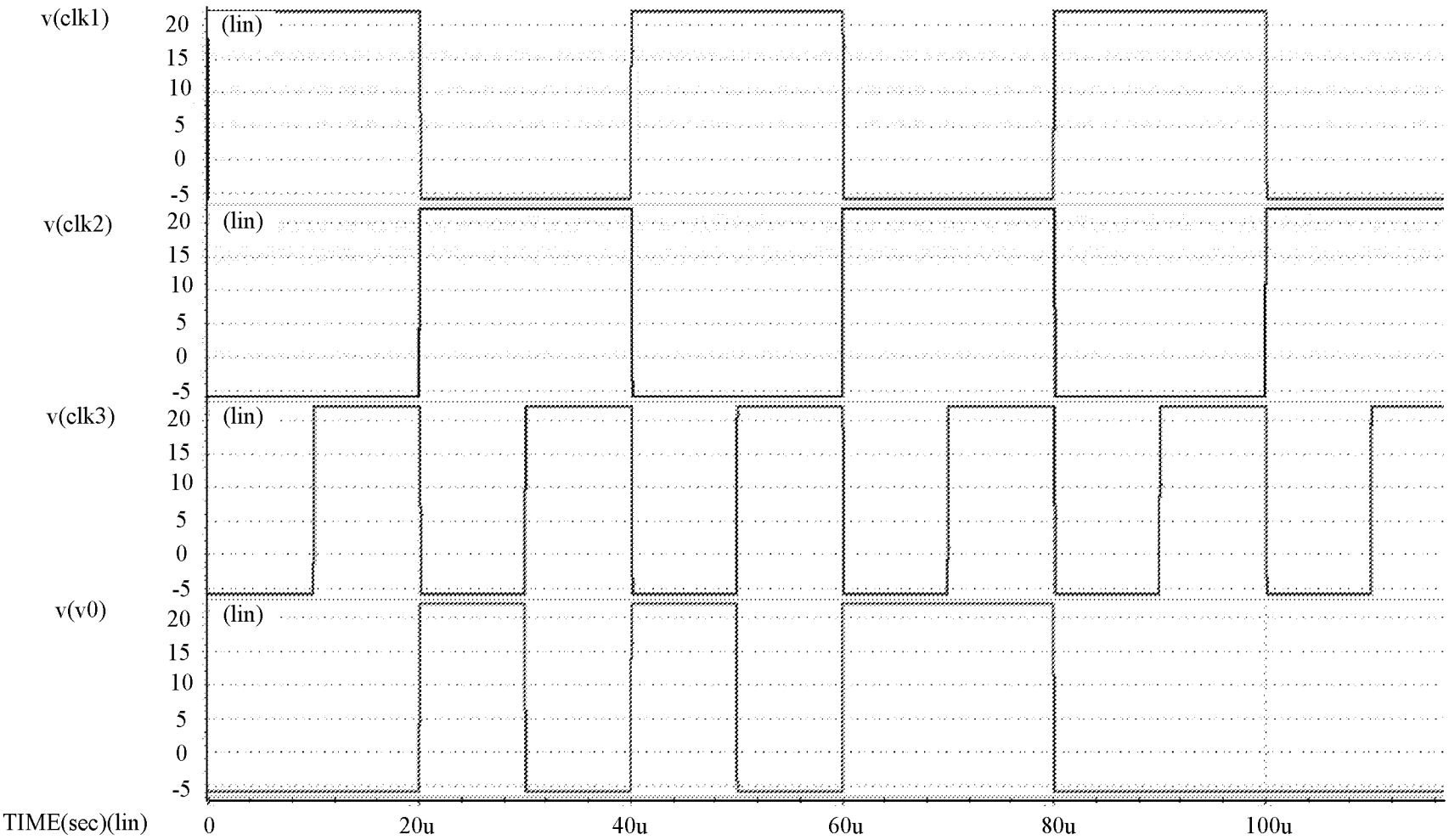
FIG. 11 shows a HSPICE simulation input time sequence confirmation according to an embodiment of the present disclosure.

FIG. 11 shows a HSPICE simulation input time sequence confirmation according to an embodiment of the present disclosure.

FIG. 12 shows a unit multi-pulse programmable simulation verification according to an embodiment of the present disclosure.

FIG. 13 shows a unit self-adaptive function simulation verification according to an embodiment of the present disclosure.

It can be seen from simulation results of FIG. 11 to FIG. 13 that the results are in accordance with the time sequence diagram in FIG. 5.

An embodiment of the present disclosure provides a display driving circuit, and the display driving circuit comprises: a gate driving circuit and a pixel driving circuit.

The gate driving circuit comprises any one of the gate driving circuits provided by the above embodiments.

The gate driving circuit in an embodiment of the present disclosure may be a gate driver On Array (GOA).

An embodiment of the present disclosure further provides a display device, comprising a display driving circuit provided by the above embodiments. The display device can be an electronic paper, a mobile phone, a tablet computer, a television, a monitor, a notebook computer, a digital photo frame, a navigator, or any products or components having a display function.

Embodiments of the present disclosure uses a circuit structure with two control circuits to control the output circuit, so that noise can be stably and continuously suppressed. In addition, an embodiment of the present disclosure can also implement a function of a programmable multi-pulse gate driving unit, and furthermore the gate driving unit of the present disclosure can be self-adaptive to a number of initial pulses, that is, a working range is not limited by the number of the pulses.

Unless otherwise defined, all the terms (including technical and scientific terms) used herein have the same meanings as commonly understood by one of ordinary skill in the art to which the present disclosure belongs. It should also be understood that, those terms, such as those defined in an common dictionary, should be interpreted as having a meaning that is consistent with a meaning in the context of the relevant technology, and should not be interpreted in an idealized or extremely formalization meaning, unless clearly defined herein.

What has been described above is illustration of the present disclosure, and should not be considered as a limitation of the present disclosure. Although some exemplary embodiments of the present disclosure have been described, one of ordinary skill in the art will readily understand that many modifications may be made on the exemplary embodiments of the present disclosure without departing from the novel teachings and advantages of the present disclosure. Therefore, all the modifications are intended to fall within the scope of the present disclosure as defined by the claims. It should be understood that, what have been described above are illustration of the present disclosure, the present disclosure should not be considered to be limited to the specific embodiments disclosed, and modifications to the disclosed embodiments and other embodiments are intended to be included within the scope of the appended claims. The present disclosure is defined by the claims and the equivalents thereof.

The application claims priority to the Chinese patent application No. 201710336104.3, filed May 12, 2017, the entire disclosure of which is incorporated herein by reference as part of the present application.

What is claimed is:

1. A gate driving unit, comprising:

an input circuit, configured to transmit an output signal of a previous-level gate driving unit to a pull-up node in a case that one of an output terminal of the previous-level gate driving unit and an output terminal of a next-level gate driving unit is at an active voltage level, and a first clock terminal is at the active voltage level;

a first control circuit, configured to provide a first power voltage signal to a first control node in a case that the pull-up node is at the active voltage level;

a second control circuit, configured to: provide a third clock signal of a third clock terminal to a second control node in a case that the pull-up node is at the active voltage level; and pull down the second control node to a second power voltage signal of a second power voltage terminal in a case that the pull-up node is at a non-active voltage level; and an output circuit, configured to output the first power voltage signal of a first power voltage terminal to the output terminal in a case that the first control node is at the active voltage level and the second control node is at the non-active voltage level.

2. A gate driving unit, comprising:

an input circuit, configured to transmit an output signal of a previous-level gate driving unit to a pull-up node in a case that one of an output terminal of the previous-level gate driving unit and an output terminal of a next-level gate driving unit is at an active voltage level, and a first clock terminal is at the active voltage level;

a first control circuit, configured to provide a first power voltage signal to a first control node in a case that the pull-up node is at the active voltage level;

a second control circuit, configured to: provide a third clock signal of a third clock terminal to a second control node in a case that the pull-up node is at the active voltage level; and pull down the second control node to a second power voltage signal of a second power voltage terminal in a case that the pull-up node is at a non-active voltage level;

an output circuit, configured to output the first power voltage signal of a first power voltage terminal to the output terminal in a case that the first control node is at the active voltage level and the second control node is at the non-active voltage level;

a pull-down control circuit, configured to control a pull-down circuit whether to carry out an operation or not by a pull-down signal at a pull-down node; and the pull-down circuit, configured to pull down the output terminal and the first control node to the second power voltage signal of the second power voltage terminal in a case that the pull-down signal at the pull-down node is at the active voltage level.

3. The gate driving unit according to claim 2, wherein the input circuit comprises:

a first input transistor, with a gate electrode and a first electrode of the first input transistor as a first input terminal being connected to the output terminal of the previous-level gate driving unit, and a second electrode of the first input transistor being connected to a first electrode of a fourth input transistor;

a second input transistor, with a first electrode of the second input transistor being connected to the output terminal of the previous-level gate driving unit, a gate electrode of the second input transistor being connected to a second electrode of a third input transistor, and a second electrode of the second input transistor being connected to the pull-up node;

the third input transistor, with a first electrode of the third input transistor as a second input terminal being connected to the output terminal of the next-level gate driving unit, and a gate electrode of the third input transistor being connected to the first clock terminal; and the fourth input transistor, with a gate electrode of the fourth input transistor being connected to the first clock terminal, and a second electrode of the fourth input transistor being connected to the pull-up node.

4. The gate driving unit according to claim 2, wherein the second power voltage terminal comprises a third power voltage terminal, a fourth power voltage terminal, and a fifth power voltage terminal, and wherein the pull-down control circuit comprises:

a first pull-down control transistor, with a gate electrode and a first electrode of the first pull-down control transistor being connected to the first power voltage terminal, and a second electrode of the first pull-down control transistor being connected to a gate electrode of a third pull-down control transistor;

a second pull-down control transistor, with a gate electrode of the second pull-down control transistor being connected to the pull-up node, a first electrode of the second pull-down control transistor being connected to the gate electrode of the third pull-down control transistor, and a second electrode of the second pull-down control transistor being connected to the third power voltage terminal;

the third pull-down control transistor, with a first electrode of the third pull-down control transistor being connected to a second clock terminal, and a second electrode of the third pull-down control transistor being connected to the pull-down node; and a fourth pull-down control transistor, with a gate electrode of the fourth pull-down control transistor being connected to the pull-up node, a first electrode of the fourth pull-down control transistor being connected to the pull-down node, and a second electrode of the fourth pull-down control transistor being connected to the fourth power voltage terminal.

5. The gate driving unit according to claim 2, wherein the first control circuit comprises:

a first control transistor, with a gate electrode of the first control transistor being connected to the pull-up node, a first electrode of the first control transistor being connected to the first power voltage terminal, and a second electrode of the first control transistor being connected to the first control node;

a second control transistor, with a gate electrode of the second control transistor being connected to the pull-down node, a first electrode of the second control transistor being connected to the first control node, and a second electrode of the second control transistor being connected to the pull-down circuit; and a third control transistor, with a gate electrode of the third control transistor being connected to the pull-up node, a first electrode of the third control transistor being connected to the first power voltage terminal, and a second electrode of the third control transistor being connected to the pull-down circuit.

6. The gate driving unit according to claim 5, wherein the second power voltage terminal comprises a third power voltage terminal, a fourth power voltage terminal, and a fifth power voltage terminal, and wherein the second control circuit comprises:

a fourth control transistor, with a gate electrode of the fourth control transistor being connected to the pull-up node, a first electrode of the fourth control transistor being connected to the third clock terminal, and a second electrode of fourth control transistor being connected to the second control node;

a fifth control transistor, with a gate electrode and a first electrode of the fifth control transistor being connected to the first power voltage terminal, and a second electrode of the fifth control transistor being connected to a gate electrode of a seventh control transistor;

a sixth control transistor, with a gate electrode of the sixth control transistor being connected to the pull-up node, a first electrode of the sixth control transistor being connected to the gate electrode of the seventh control transistor, a second electrode of the sixth control transistor being connected to the fourth power voltage terminal; and the seventh control transistor, with a first electrode of the seventh control transistor being connected to the second control node, and a second electrode of the seventh control transistor being connected to the fifth power voltage terminal.

7. The gate driving unit according to claim 6, wherein the output terminal comprises a first output terminal and a second output terminal;

the output circuit comprises a first output circuit and a second output circuit;

the first output circuit comprises:

a first output transistor, with a gate electrode of the first output transistor being connected to the first control node, a first electrode of the first output transistor being connected to the first power voltage terminal, and a second electrode of the first output transistor being connected to the first output terminal; and a second output transistor, with a gate electrode of the second output transistor being connected to the second control node, a first electrode of the second output transistor being connected to the first output terminal, and a second electrode of the second output transistor being connected to the fourth power voltage terminal, and the second output circuit comprises:

a third output transistor, with a gate electrode of the third output transistor being connected to the first control node, a first electrode of the third output transistor being connected to the first power voltage terminal, and a second electrode of the third output transistor being connected to the second output terminal; and a fourth output transistor, with a gate electrode of the fourth output transistor being connected to the second control node, a first electrode of the fourth output transistor being connected to the second output terminal, and a second electrode of the fourth output transistor being connected to the third power voltage terminal.

8. The gate driving unit according to claim 7, wherein the pull-down circuit comprises:

a node pull-down transistor, with a gate electrode of the node pull-down transistor being connected to the pull-down node, a first electrode of the node pull-down transistor being connected to the second electrode of the second control transistor, and a second electrode of the node pull-down transistor being connected to the third power voltage terminal;

a first output pull-down transistor, with a gate electrode of the first output pull-down transistor being connected to the pull-down node, a first electrode of the first output pull-down transistor being connected to the first output terminal, and a second electrode of the first output pull-down transistor being connected to the third power voltage terminal; and a second output pull-down transistor, with a gate electrode of the second output pull-down transistor being connected to the pull-down node, a first electrode of the second output pull-down transistor being connected to the second output terminal, and a second electrode of the second output pull-down transistor being connected to the third power voltage terminal.

9. The gate driving unit according to claim 2, wherein the pull-down control circuit comprises:

a first pull-down control transistor, with a gate electrode and a first electrode of the first pull-down control transistor being connected to the first power voltage terminal, and a second electrode of the first pull-down control transistor being connected to a gate electrode of a third pull-down control transistor;

a second pull-down control transistor, with a gate electrode of the second pull-down control transistor being connected to the pull-up node, a first electrode of the second pull-down control transistor being connected to the gate electrode of the third pull-down control transistor, and a second electrode of the second pull-down control transistor being connected to the second power voltage terminal;

the third pull-down control transistor, with a first electrode of the third pull-down control transistor being connected to a second clock terminal, and a second electrode of the third pull-down control transistor being connected to the pull-down node; and a fourth pull-down control transistor, with a gate electrode of the fourth pull-down control transistor being connected to the pull-up node, a first electrode of the fourth pull-down control transistor being connected to the pull-down node, and a second electrode of the fourth pull-down control transistor being connected to the second power voltage terminal.

10. The gate driving unit according to claim 5, wherein the second control circuit comprises:

a fourth control transistor, with a gate electrode of the fourth control transistor being connected to the pull-up node, a first electrode of the fourth control transistor being connected to the third clock terminal, and a second electrode of fourth control transistor being connected to the second control node;

a fifth control transistor, with a gate electrode and a first electrode of the fifth control transistor being connected to the first power voltage terminal, and a second electrode of the fifth control transistor being connected to a gate electrode of a seventh control transistor;

a sixth control transistor, with a gate electrode of the sixth control transistor being connected to the pull-up node, a first electrode of the sixth control transistor being connected to the gate electrode of the seventh control transistor, and a second electrode of the sixth control transistor being connected to the second power voltage terminal; and the seventh control transistor, with a first electrode of the seventh control transistor being connected to the second control node, and a second electrode of the seventh control transistor being connected to the second power voltage terminal.

11. The gate driving unit according to claim 10, wherein the output circuit comprises:

a first output transistor, with a gate electrode of the first output transistor being connected to the first control node, a first electrode of the first output transistor being connected to the first power voltage terminal, and a second electrode of the first output transistor being connected to the output terminal; and a second output transistor, with a gate electrode of the second output transistor being connected to the second control node, a first electrode of the second output transistor being connected to the output terminal, and a second electrode of the second output transistor being connected to the second power voltage terminal.

12. The gate driving unit according to claim 11, wherein the pull-down circuit comprises:

a node pull-down transistor, with a gate electrode of the node pull-down transistor being connected to the pull-down node, a first electrode of the node pull-down transistor being connected to the second electrode of the second control transistor, and a second electrode of the node pull-down transistor being connected to the second power voltage terminal; and an output pull-down transistor, with a gate electrode of the output pull-down transistor being connected to the pull-down node, a first electrode of the output pull-down transistor being connected to the output terminal, and a second electrode of the output pull-down transistor being connected to the second power voltage terminal.

13. The gate driving unit according to claim 1, wherein a first clock signal of the first clock terminal and a second clock signal of a second clock terminal are opposite in phase and have a same frequency, and a frequency of the third clock signal of the third clock terminal is twice of a frequency of the first clock signal of the first clock terminal.

14. A gate driving circuit, comprising N gate driving units connected in cascade, wherein the N gate driving units comprise a first gate driving unit to an Nth gate driving unit, each gate driving unit includes the gate driving unit according to claim 1, and N is an integer greater than or equal to 2.

15. The gate driving circuit according to claim 14, wherein in the N gate driving units connected in cascade, a first signal input terminal of the first gate driving unit is connected to a frame start signal, and a second signal input terminal of the Nth gate driving unit is connected to the frame start signal;

first signal input terminals of each of a second gate driving unit to the Nth gate driving unit are connected to output terminals of respective previous-level gate driving units adjacent thereto; and second signal input terminals of each of the first gate driving unit to an (N−1)th gate driving unit are connected to output terminals of respective next-level gate driving units adjacent thereto.

16. A display driving circuit, comprising: a gate driving circuit and a pixel driving circuit, wherein the gate driving circuit comprises the gate driving circuit according to claim 14.

17. A display device, comprising the display driving circuit according to claim 16.

18. The gate driving unit according to claim 2, wherein a first clock signal of the first clock terminal and a second clock signal of a second clock terminal are opposite in phase and have a same frequency, and a frequency of the third clock signal of the third clock terminal is twice of a frequency of the first clock signal of the first clock terminal.

19. A gate driving circuit, comprising N gate driving units connected in cascade, wherein the N gate driving units comprise a first gate driving unit to an Nth gate driving unit, each gate driving unit includes the gate driving unit according to claim 2, and N is an integer greater than or equal to 2.

20. The gate driving circuit according to claim 19, wherein, in the N gate driving units connected in cascade, a first signal input terminal of the first gate driving unit is connected to a frame start signal, and a second signal input terminal of the Nth gate driving unit is connected to the frame start signal;

first signal input terminals of each of a second gate driving unit to the Nth gate driving unit are connected to output terminals of respective previous-level gate driving units adjacent thereto; and second signal input terminals of each of the first gate driving unit to an (N−1)th gate driving unit are connected to output terminals of respective next-level gate driving units adjacent thereto.

* * * * *